US006044503A

United States Patent [19]

McClendon

[11] Patent Number: 6,044,503

[45] Date of Patent: Apr. 4, 2000

[54] BEDCLOTHES

[76] Inventor: Virginia S. McClendon, 1188 Saxon St., Memphis, Tenn. 38106

[21] Appl. No.: 09/119,709

[22] Filed: Jul. 20, 1998

Related U.S. Application Data

[63] Continuation-in-part of application No. 08/908,339, Aug. 7, 1997.

[51] Int. Cl.[7] ..... A47G 9/02

[52] U.S. Cl. ..... 5/482; 5/493; 5/497; 5/498

[58] Field of Search ..... 5/482, 493, 496, 5/498, 692, 490, 497

[56] References Cited

U.S. PATENT DOCUMENTS

| | | | |
|---|---|---|---|
| 2,245,779 | 6/1941 | Heil | 5/493 X |
| 4,035,854 | 7/1977 | Pardee | 5/497 |
| 4,301,561 | 11/1981 | McLeod . | |
| 4,413,368 | 11/1983 | Schuetze | 5/496 X |
| 4,488,323 | 12/1984 | Colburn . | |
| 4,734,947 | 4/1988 | Vitale | 5/493 |
| 4,924,543 | 5/1990 | Hoss et al. | 5/484 |
| 5,099,531 | 3/1992 | Schmier | 5/496 X |
| 5,321,862 | 6/1994 | Campbell | 5/482 |
| 5,335,383 | 9/1994 | Schwind . | |
| 5,438,719 | 8/1995 | Anthony | 5/490 |
| 5,557,814 | 9/1996 | Cybulski . | |
| 5,621,931 | 4/1997 | Hamilton . | |
| 5,638,562 | 6/1997 | Masoncup . | |

*Primary Examiner*—Terry Lee Melius
*Assistant Examiner*—Frederick Conley
*Attorney, Agent, or Firm*—Walker, McKenzie & Walker, P.C.

[57] ABSTRACT

Bedclothes for a bed having a mattress. At a minimum, the bedclothes include a fitted sheet including a top for covering the top of the mattress, a head side depending from the top thereof for covering the head side of the mattress, a foot side depending from the top thereof for covering the foot side of the mattress, a left side depending from the top thereof for covering the left side of the mattress, and a right side depending from the top thereof for covering the right side of the mattress; a flat sheet including a top for covering at least a portion of the top of the fitted sheet, and a foot side depending from the top thereof for covering at least a portion of the foot side of the fitted sheet; a bed skirt including a foot side, a left side, and a right side; and structure fixing the foot side of the flat sheet to the foot side of the fitted sheet, fixing the foot side of the bed skirt to the foot side of the fitted sheet, fixing the left side of the bed skirt to the left side of the fitted sheet, and fixing the right side of the bed skirt to the right side of the fitted sheet.

2 Claims, 3 Drawing Sheets

BEDCLOTHES

CROSS-REFERENCE TO RELATED APPLICATIONS

This is a continuation-in-part of application Ser. No. 08/908,339, entitled "ONE UNIT SET OF LINEN AND BEDDING APPAREL WITH DETACHABLE PARTS," filed Aug. 7, 1997, now pending. Such specifically enumerated prior application is hereby incorporated herein by reference.

STATEMENT RE FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

The present invention relates, in general, to bedclothes used to make a bed, and, more specifically, to the combination a first or fitted sheet for covering the top of a mattress and a second, top or flat sheet for covering the top of the fitted sheet with the foot end of the flat sheet attached to the foot end of the fitted sheet.

2. Information Disclosure Statement

Various specific types and designs of bedclothes, commonly including various covering (as sheets, comforters, bed skirts, pillow cases) used on a bed, are well known to those skilled in the art. However, to make a bed using typical bedclothes, each separate piece is put on the bed one at a time.

The following patents were cited in the above identified prior application and appear to be relevant to the present invention:

McLeod, U.S. Pat. No. 4,301,561, issued Nov. 24, 1981, discloses a separable, fitted liner and bed sheet for a waterbed. The bottom sheet has U-shaped cutouts at the corners thereof and is attached to an underliner using Velcro® fasteners or the like. The foot end of a top sheet is sewn or stitched to the foot end of the bottom sheet.

Colbumn, U.S. Pat. No. 4,488,323, issued Dec. 18, 1984, discloses bedding including a mattress pad, a sheet, and coacting hook-and-loop type fastening means with one part of the fastening means attached to the sides of a waterbed mattress or the like, and with other parts of the fastening means attached to the mattress pad and sheet so that the mattress pad and sheet can be secured to the mattress without lifting the ends of the mattress.

Schwind, U.S. Pat. No. 5,335,383, issued Aug. 9, 1994, discloses the combination of a flat sheet for being positioned between a mattress and box springs and having a hook-and-loop type fastening strip attached around its perimeter, and a bed skirt having a hook-and-loop type fastening strip attached around its upper edge so that the bed skirt can be removably attached to the bed by joining the two fastening strips between the mattress and box springs.

Cybulski, U.S. Pat. No. 5,557,814, issued Nov. 24, 1996, discloses a bed sheeting arrangement including a fitted lower sheet including a non-elastic drawstring for securing the lower sheet to the mattress, an upper covering, and a two part fastener such as a zipper for attaching the foot end of the upper covering to the foot end of the lower sheet.

Hamilton, U.S. Pat. No. 5,621,931, issued Apr. 22, 1997, discloses a bedskirt assembly including a non-slip grip deck installed between a mattress and box springs, and a bed skirt attached to the edges of the non-slip grip deck using Velcro® fasteners or the like.

Masoncup, U.S. Pat. No. 5,638,562, issued Jun. 17, 1997, discloses a fitted mattress pad foundation for being attached to an upper mattress, and a dust ruffle for being mounted around three edges of a lower mattress. The fitted mattress pad foundation includes extended side panels having first fasteners attached to an outer lower end thereof. The dust ruffle includes a band of flat material attached along an upper edge of a sheet of dust ruffle material. Second fasteners are attached along an inner upper edge of the band of flat material. The fitted mattress pad foundation is placed onto the upper mattress with the extended side panels positioned alongside the lower mattress. The dust ruffle is then attached around three edges of the bed by securing the first and second fasteners (e.g., coacting Velcro® brand fasteners) to one another. The secured edges of the extended side panels of the fitted mattress pad foundation and the band of flat material of the dust ruffle are then tucked in between the upper and lower mattress.

Nothing in the known prior art discloses or suggests the present invention. More specifically, nothing in the known prior art discloses or suggests bedclothes including a fitted sheet having a top for covering the top of a mattress, a head side depending from the top thereof for covering the head side of the mattress, a foot side depending from the top thereof for covering the foot side of the mattress, a left side depending from the top thereof for covering the left side of the mattress, and a right side depending from the top thereof for covering the right side of the mattress; a flat sheet having a top for covering at least a portion of the top of the fitted sheet, and a foot side depending from the top thereof for covering at least a portion of the foot side of the fitted sheet; a bed skirt including a foot side, a left side, and a right side; and fixing means fixing the foot side of the flat sheet to the foot side of the fitted sheet, fixing the foot side of the bed skirt to the foot side of the fitted sheet, fixing the left side of the bed skirt to the left side of the fitted sheet, and fixing the right side of the bed skirt to the right side of the fitted sheet.

BRIEF SUMMARY OF THE INVENTION

The present invention provides bedclothes for making a bed in a efficient, timesaving manner. A basic concept of the present invention is to provide bedclothes in which at least the bottom or fitted sheet and top or flat sheet are simultaneously attached to the mattress.

The bedclothes of the present invention comprise, in general, a fitted sheet including a top for covering the top of a mattress, a head side depending from the top thereof for covering the head side of the mattress, a foot side depending from the top thereof for covering the foot side of the mattress, an left side depending from the top thereof for covering the left side of the mattress; and a right side depending from the top thereof for covering the right side of the mattress; a flat sheet including a top for covering at least a portion of the top of the fitted sheet, and a foot side depending from the top thereof for covering at least a portion of the foot side of the fitted sheet; a bed skirt including a foot side, a left side, and a right side; and fixing means fixing the foot side of the flat sheet to the foot side of the fitted sheet, fixing the foot side of the bed skirt to the foot side of the fitted sheet, fixing the left side of the bed skirt to the left side of the fitted sheet, and fixing the right side of the bed skirt to the right side of the fitted sheet.

DETAILED DESCRIPTION OF THE INVENTION

The present invention relates to bedclothes for making a bed. The term "bedclothes" is used herein in its common meaning to include various covering (as sheets, comforters, bed skirts, pillow cases) used on a bed.

Figure 1:
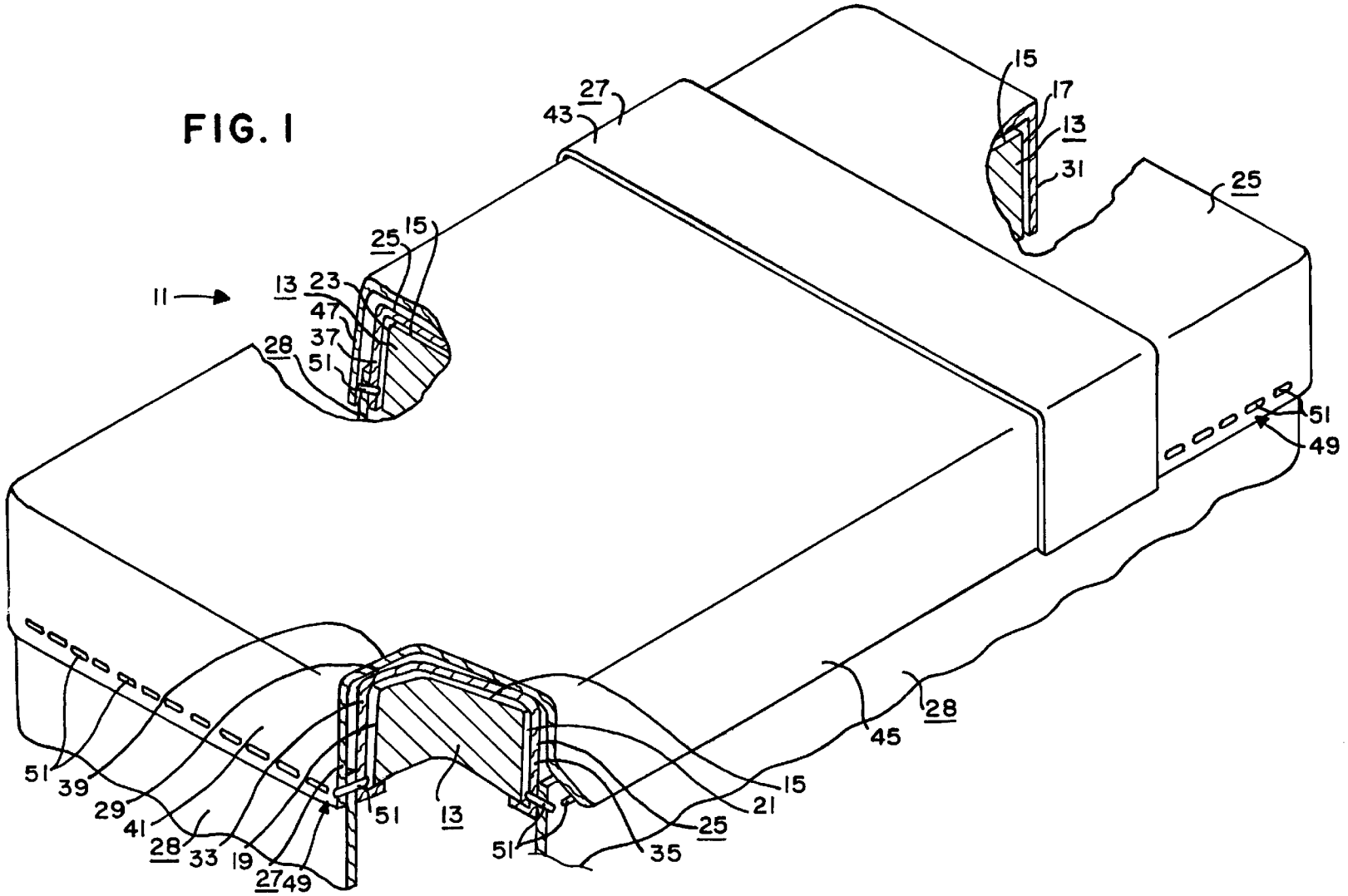
FIG. 1 is perspective view of a first embodiment of the bedclothes of the present invention shown in combination with a bed, with portions thereof broken away for clarity.

A first preferred embodiment of the bedclothes of the present invention is shown somewhat diagrammatically in FIG. 1, and identified by the numeral 11. The bedclothes 11 are for any bed having a mattress 13 with a top 15, a head end or side 17, a foot end or side 19, a left side 21, and a right side 23. The mattress 13 may be any size and may be a standard mattress, a waterbed mattress, or the like. The bedclothes 11 include, in general, a bottom or fitted sheet 25 and a top or flat sheet 27, and a bed skirt 28.

The fitted sheet 25 includes a top 29 for covering the top 15 of the mattress 13, a head end or side 31 depending from the top 29 thereof for covering the head side 17 of the mattress 13, a foot end or side 33 depending from the top 29 thereof for covering the foot side 19 of the mattress 13, a left side 35 depending from the top 29 thereof for covering the left side 21 of the mattress 13, and a right side 37 depending from the top 29 thereof for covering the right side 23 of the mattress 13. The fitted sheet 25 may be constructed in any typical manner and out of any typical material as will now be apparent to those skilled in the art such as, for example, by being sewn out of cotton material, etc. The size and specific design of the fitted sheet 25 may also vary as will be apparent to those skilled in the art. However, the fitted sheet 25 preferably has typical fitted corners to form pockets or the like for receiving the corners of the mattress 13 in the common manner now apparent to those skilled in the art.

The flat sheet 27 includes a top 39 for covering at least a portion of the top 29 of the fitted sheet 25, and a foot end or side 41 depending from the top 29 thereof for covering at least a portion of the foot side 33 of the fitted sheet 25. Typically, the flat sheet 27 also includes a head end or edge 43, a left side or edge 45, and a right side or edge 47. The flat sheet 27 may be constructed in any typical manner and out of any typical material as will now be apparent to those skilled in the art such as, for example, by being cut and sewn out of cotton material, etc. The size and specific design of the flat sheet 27 may also vary but normally conforms to the size and specific design of the fitted sheet 25, etc., as will be apparent to those skilled in the art.

The bed skirt 28, often referred to as a dust ruffle, has a foot side 57, a left side 59, and a right side 61. The bed skirt 28 may be constructed in any typical manner and out of any typical material as will now be apparent to those skilled in the art such as, for example, by being cut and sewn out of cotton material, etc. The size and specific design of the bed skirt 28 may also vary but normally conforms to the size and specific design of the fitted sheet 25 and flat sheet 27, etc., as will be apparent to those skilled in the art.

The bedclothes 11 include fixing means 49 fixing the foot side 41 of the flat sheet 27 to the foot side 33 of the fitted sheet 25, fixing the foot side 57 of the bed skirt 28 to the foot side 33 of the fitted sheet 25, fixing the left side 59 of the bed skirt 28 to the left side 35 of the fitted sheet 25, and fixing the right side 61 of the bed skirt 28 to the right side 37 of the fitted sheet 25. The fixing means 49 may consist of various specific means the various components together such as, for example, a plurality of coacting male and female snap members mounted on the various components to allow the flat sheet 27 and bed skirt 28 to be removably attached to the fitted sheet 25, pieces of Velcro® brand hook-and-loop fasteners or the equivalent mounted on the various components to allow the flat sheet 27 and bed skirt 28 to be removably attached to the fitted sheet 25, one or more zippers attached to the various components to allow the flat sheet 27 and bed skirt 28 to be removably attached to the fitted sheet 25, a quantity of fabric glue or the like on the various components to allow the flat sheet 27 and bed skirt 28 to be permanently attached to the fitted sheet 25, etc. Preferably, however, the fixing means 49 includes thread 51 sewing the foot side 41 of the flat sheet 27 to the foot side 33 of the fitted sheet 25 to permanently attach the foot side 41 of the flat sheet 27 to the foot side 33 of the fitted sheet 25 via a plurality of stitches or the like extending substantially across the foot side 41 of the flat sheet 27 and the foot side 33 of the fitted sheet 25; sewing the foot side 57 of the bed skirt 28 to the foot side 33 of the fitted sheet 25 to permanently attach the foot side 57 of the bed skirt 28 to the foot side 33 of the fitted sheet 25 via a plurality of stitches or the like extending substantially across the foot side 57 of the bed skirt 28 and the foot side 33 of the fitted sheet 25; sewing the left side 59 of the bed skirt 28 to the left side 35 of the fitted sheet 25 to permanently attach the left side 59 of the bed skirt 28 to the left side 35 of the fitted sheet 25 via a plurality of stitches or the like extending substantially across the left side 59 of the bed skirt 28 and the left side 35 of the fitted sheet 25; and sewing the right side 61 of the bed skirt 28 to the right side 37 of the fitted sheet 25 to permanently attach the right side 61 of the bed skirt 28 to the right side 37 of the fitted sheet 25 via a plurality of stitches or the like extending substantially across the right side 61 of the bed skirt 28 and the right side 37 of the fitted sheet 25, as will now be apparent to those skilled in the art.

Figure 2:
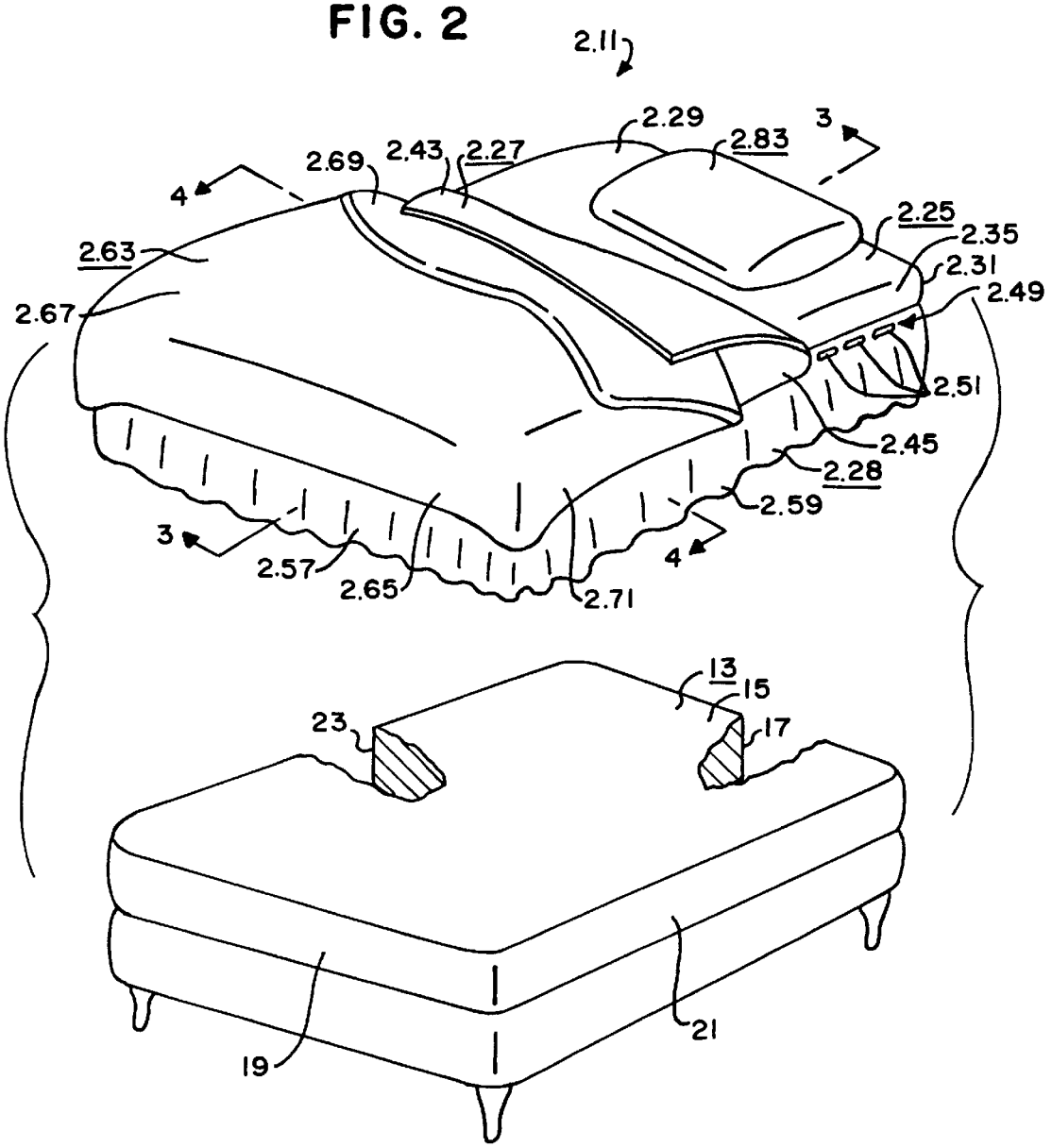
FIG. 2 is an exploded perspective view of a second embodiment of the bedclothes of the present invention shown in combination with a bed, with portions thereof broken away for clarity.
Figure 3:
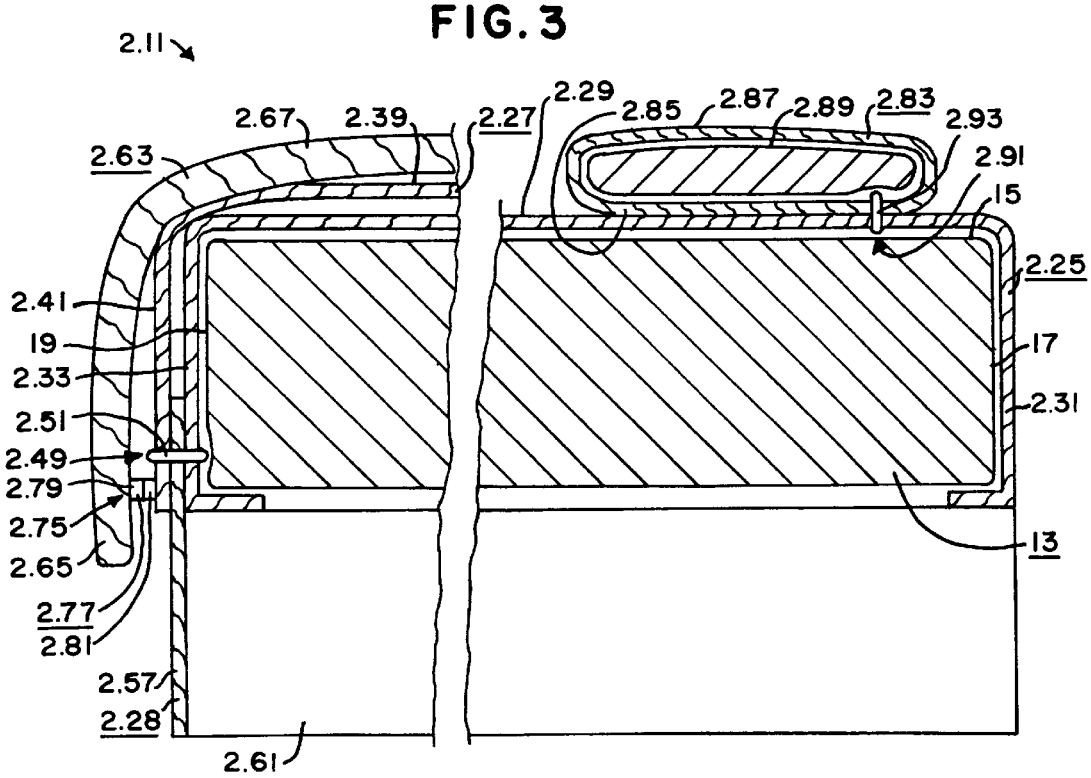
FIG. 3 is a sectional view of the bedclothes of the present invention substantially as taken on line 3—3 of FIG. 2 but showing the bedclothes thereof mounted on the bed, with portions thereof broken away for clarity.
Figure 4:
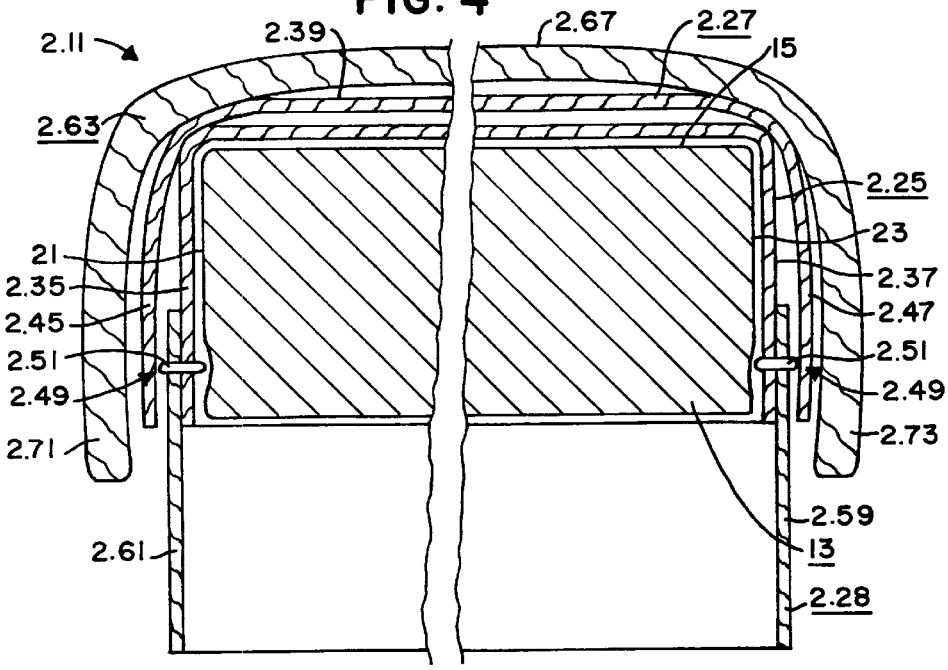
FIG. 4 is a sectional view of the bedclothes of the present invention substantially as taken on line 4—4 of FIG. 2 but showing the bedclothes thereof mounted on the bed, with portions thereof broken away for clarity.

A second preferred embodiment of the bedclothes of the present invention is shown somewhat diagrammatically in FIGS. 2–4, and identified by the numeral 2.11. Like the bedclothes 11, the bedclothes 2.11 are for any bed having a mattress 13 with a top 15, a head end or side 17, a foot end or side 19, a left side 21, and a right side 23. The mattress 13 may be any size and may be a standard mattress, a waterbed mattress, or the like.

The bedclothes 2.11 include, in general, a bottom or fitted sheet 2.25, a top or flat sheet 2.27, and a bed skirt 2.28.

The fitted sheet 2.25 may be substantially identical to the fitted sheet 25, and includes a top 2.29 for covering the top 15 of the mattress 13, a head end or side 2.31 depending from the top 2.29 thereof for covering the head side 17 of the mattress 13, a foot end or side 2.33 depending from the top 2.29 thereof for covering the foot side 19 of the mattress 13, a left side 2.35 depending from the top 2.29 thereof for covering the left side 21 of the mattress 13, and a right side 2.37 depending from the top 2.29 thereof for covering the right side 23 of the mattress 13. The fitted sheet 2.25 may be constructed in any typical manner and out of any typical material as will now be apparent to those skilled in the art such as, for example, by being sewn out of cotton material, etc. The size and specific design of the fitted sheet 2.25 may also vary as will be apparent to those skilled in the art. However, the fitted sheet 2.25 preferably has typical fitted corners to form pockets or the like for receiving the corners of the mattress 13 in the common manner now apparent to those skilled in the art.

The flat sheet 2.27 may be substantially identical to the flat sheet 27, and includes a top 2.39 for covering at least a portion of the top 2.29 of the fitted sheet 2.25, and a foot end or side 2.41 depending from the top 2.29 thereof for covering at least a portion of the foot side 2.33 of the fitted sheet 2.25. Typically, the flat sheet 2.27 also includes a head end or edge 2.43, a left side or edge 2.45, and a right side or edge 2.47. The flat sheet 2.27 may be constructed in any typical manner and out of any typical material as will now be apparent to those skilled in the art such as, for example, by being cut and sewn out of cotton material, etc. The size and specific design of the flat sheet 2.27 may also vary but normally conforms to the size and specific design of the fitted sheet 2.25, etc., as will be apparent to those skilled in the art.

The bed skirt 2.28 may be substantially identical to the bed skirt 2.28, having a foot side 2.57, a left side 2.59, and a right side 2.61. The bed skirt 2.28 may be constructed in any typical manner and out of any typical material as will now be apparent to those skilled in the art such as, for example, by being cut and sewn out of cotton material, etc. The size and specific design of the bed skirt 2.28 may also vary but normally conforms to the size and specific design of the fitted sheet 2.25 and flat sheet 2.27, etc., as will be apparent to those skilled in the art.

The bedclothes 2.11 include fixing means 2.49 fixing the foot side 2.41 of the flat sheet 2.27 to the foot side 2.33 of the fitted sheet 2.25, fixing the foot side 2.57 of the bed skirt 2.28 to the foot side 2.33 of the fitted sheet 2.25, fixing the left side 2.59 of the bed skirt 2.28 to the left side 2.35 of the fitted sheet 2.25, and fixing the right side 2.61 of the bed skirt 2.28 to the right side 2.37 of the fitted sheet 2.25. The fixing means 2.49 may consist of various specific means for attaching the various components together as disclosed hereinabove relative to the fixing means 49. Preferably, however, the fixing means 2.49 includes thread 2.51 sewing the foot side 2.41 of the flat sheet 2.27 and the foot side 2.57 of the bed skirt 2.28 to the foot side 2.33 of the fitted sheet 2.25, sewing the left side 2.59 of the bed skirt 2.28 to the left side 2.35 of the fitted sheet 2.25, and sewing the right side 2.61 of the bed skirt 2.28 to the right side 2.37 of the fitted sheet 2.25 to permanently attach the various components together via a plurality of stitches or the like extending substantially across the foot side 2.41 of the flat sheet 2.27; the foot side 2.33, left side 2.35 and right side 2.37 of the fitted sheet 2.25; and the foot side 2.57, left side 2.59 and right side 2.61 of the bed skirt 2.28 as will now be apparent to those skilled in the art.

The bedclothes 2.11 includes a comforter 2.63 having a foot side 2.65. Typically, the comforter 2.63 also includes a top 2.67, a head end or side 2.69, a left side 2.71, and a right side 2.73. The comforter 2.63 may be constructed in any typical manner and out of any typical material as will now be apparent to those skilled in the art such as, for example, by being sewn out of cotton material with a polyester fill material, etc. The size and specific design of the comforter 2.63 may also vary, but normally conforms to the size and specific design of the fitted sheet 2.25 and flat sheet 2.27, etc., as will be apparent to those skilled in the art.

The bedclothes 2.11 includes comforter attaching means 2.75 attaching the foot side 2.65 of the comforter 2.63 to the foot side 2.33 of the fitted sheet 2.25. The comforter attaching means 2.75 may consist of various specific means for attaching the various components together such as, for example, pieces of Velcro® brand hook-and-loop fasteners or the equivalent to allow the foot side 2.65 of the comforter 2.63 to be removably attached to the foot side 2.33 of the fitted sheet 2.25, a quantity of fabric glue or the like between the foot side 2.65 of the comforter 2.63 and the foot side 2.33 of the fitted sheet 2.25 to permanently attach the foot side 2.65 of the comforter 2.63 to the foot side 2.33 of the fitted sheet 2.25, thread sewing the foot side 2.65 of the comforter 2.63 to the foot side 2.33 of the fitted sheet 2.25 to permanently attach the foot side 2.65 of the comforter 2.63 to the foot side 2.33 of the fitted sheet 2.25 via a plurality of stitches or the like, etc. Preferably, however, the comforter attaching means 2.75 includes snaps means 2.77 removably attaching the foot side 2.65 of the comforter 2.63 to the foot side 2.33 of the fitted sheet 2.25 as will now be apparent to those skilled in the art. The snap means 2.77 may include a plurality of coacting male and female snap members running along the foot side 2.65 of the comforter 2.63 and the foot side 2.33 of the fitted sheet 2.25 to allow the foot side 2.65 of the comforter 2.63 to be removably the foot side 2.33 of the fitted sheet 2.25. More specifically, the snap means 2.77 may include a plurality of spaced apart female snap members 2.79 attached to and running along the foot side 2.65 of the comforter 2.63, and a plurality of spaced apart coacting male snap members 2.81 attached to and running along the foot side 2.41 of the flat sheet 2.27 which is, in turn, fixedly attached to the foot side 2.33 of the fitted sheet 2.25 to thereby removably attaching the foot side 2.65 of the comforter 2.63 to the foot side 2.33 of the fitted sheet 2.25 as will now be apparent to those skilled in the art.

The bedclothes 2.11 preferably includes a pillow case 2.83 having a back or bottom side 2.85. Typically, the pillow case 2.83 also includes a front or top side 2.87 associated with the back side 2.85 to form a hollow pocket or case with one opened end for receiving a typical pillow 2.89, etc., as will now be apparent to those skilled in the art. The pillow case 2.83 may be constructed in any typical manner and out of any typical material as will now be apparent to those skilled in the art such as, for example, by being cut and sewn out of cotton material, etc. The size and specific design of the pillow case 2.83 may also vary but normally conforms to the size and specific design of the fitted sheet 2.25 and flat sheet 2.27, etc., as will be apparent to those skilled in the The bedclothes 2.11 preferably includes pillow case fixing means 2.91 fixing the back side 2.85 of the pillow case 2.83 to the top 2.29 of the fitted sheet 2.25 at a location adjacent the head side 2.31 of the fitted sheet 2.25. The fixing means 2.49 may consist of various specific means for attaching the various components together as disclosed hereinabove relative to the fixing means 2.49. Preferably, however, the pillow case fixing means 2.93 includes thread 2.95 sewing the back side 2.85 of the pillow case 2.83 to the top 2.29 of the fitted sheet 2.25 at a location adjacent the head side 2.31 of the fitted sheet 2.25 to permanently attach the pillow case 2.83 and fitted sheet 2.25 together via a plurality of stitches or the like as will now be apparent to those skilled in the art.

The use and operation of both embodiments of the present invention provides a set of bedclothes that offers a more efficient way of making a bed. Thus, to make a bed using the bedclothes 11 of the present invention, you merely place the corner pockets of the fitted sheet 25 over the corresponding corners of the mattress 13 to simultaneously attach both the fitted sheet 25 and flat sheet 27 to the mattress 13. If desired, a bed spread or comforter, etc., can then be spread or thrown across the top of the bedclothes 11. Similarly, to make a bed using the bedclothes 2.11 of the present invention, you merely place the corner pockets of the fitted sheet 2.25 over the corresponding corners of the mattress 13 to simultaneously attach both the fitted sheet 2.25, flat sheet 2.27, bed skirt 2.28, comforter 2.63, etc., to the mattress 13.

Although the present invention has been described and illustrated with respect to preferred embodiment and preferred use therefor, it is not to be so limited since modifications and changes can be made therein which are within the full intended scope of the invention.

I claim:

1. Bedclothes for a bed having a mattress with a top, a head side, a foot side, a left side, and a right side; said bedclothes comprising:

(a) a fitted sheet including a top for covering the top of the mattress, a head side depending from said top thereof for covering the head side of the mattress, a foot side depending from said top thereof for covering the foot side of the mattress, a left side depending from said top thereof for covering the left side of the mattress, and a right side depending from said top thereof for covering the right side of the mattress;

(b) a flat sheet including a top for covering at least a portion of said top of said fitted sheet, and a foot side depending from said top thereof for covering at least a portion of said foot side of said fitted sheet;

(c) a bed skirt including a foot side, a left side, and a right side; and (d) fixing means fixing only said foot side of said flat sheet to said foot side of said fitted sheet, leaving all but said foot side of said flat sheet unfixed to said fitted sheet, fixing said foot side of said bed skirt to said foot side of said fitted sheet, fixing said left side of said bed skirt to said left side of said fitted sheet, and fixing said right side of said bed skirt to said right side of said fitted sheet; said fixing means including thread sewing said foot side of said flat sheet to said foot side of said fitted sheet.

2. Bedclothes for a bed having a mattress with a top, a head side, a foot side, a left side and a right side; said bedclothes comprising:

(a) a fitted sheet including a top for covering the top of the mattress, a head side depending from said top thereof for covering the head side of the mattress, a foot side depending from said top thereof for covering the foot side of the mattress, a left side depending from said top thereof for covering the left side of the mattress, and a right side depending from said top thereof for covering the right side of the mattress;

(b) a flat sheet including a top for covering at least a portion of said top of said fitted sheet, and a foot side depending, from said top thereof for covering at least a portion of said foot side of said fitted sheet;

(c) a bed skirt including a foot side, a left side, and a right side;

(d) fixing means fixing only said foot side of said flat sheet to said foot side of said fitted sheet, leaving all but said foot side of said flat sheet unfixed to said fitted sheet, fixing said foot side of said bed skirt to said foot side of said fitted sheet, fixing said left side of said bed skirt to said left side of said fitted sheet, fixing said right side of said bed skirt to said right side of said fitted sheet; said fixing means including thread sewing said foot side of said flat sheet to said foot side of said fitted sheet, sewing said foot side of said bed skirt to said foot side of said fitted sheet, sewing said left side of said bed skirt to said left side of said fitted sheet, sewing said right side of said bed skirt to said right side of said fitted sheet;

(e) a comforter having a foot side; and (f) comforter attaching means attaching said foot side of said comforter to said foot side of said fitted sheet.

* * * * *

US006044503C1

(12) EX PARTE REEXAMINATION CERTIFICATE (7237th)

United States Patent
McClendon

(10) Number: US 6,044,503 C1
(45) Certificate Issued: Dec. 15, 2009

(54) BED CLOTHING

(75) Inventor: Virginia S. McClendon, Memphis, TN (US)

(73) Assignee: PNC Bank, National Association, Towson, MD (US)

Reexamination Request:
No. 90/009,264, Aug. 29, 2008

Reexamination Certificate for:

| | |
|---|---|
| Patent No.: | **6,044,503** |
| Issued: | **Apr. 4, 2000** |
| Appl. No.: | **09/119,709** |
| Filed: | **Jul. 20, 1998** |

Related U.S. Application Data

(63) Continuation-in-part of application No. 08/908,339, filed on Aug. 7, 1997, now abandoned.

(51) Int. Cl.
*A47G 9/02* (2006.01)

(52) U.S. Cl. ..... 5/482; 5/493; 5/497; 5/498

(58) Field of Classification Search ..... None
See application file for complete search history.

(56) References Cited

U.S. PATENT DOCUMENTS

| | | | |
|---|---|---|---|
| 4,137,582 | A | 2/1979 | Korp |
| 4,413,368 | A | 11/1983 | Schuetze |
| 4,615,061 | A | 10/1986 | Scott |
| 5,566,411 | A | 10/1996 | Eiler |

FOREIGN PATENT DOCUMENTS

| | | |
|---|---|---|
| GB | 1013052 | 12/1965 |

*Primary Examiner*—Catherine S. Williams

(57) ABSTRACT

Bedclothes for a bed having a mattress. At a minimum, the bedclothes include a fitted sheet including a top for covering the top of the mattress, a head side depending from the top thereof for covering the head side of the mattress, a foot side depending from the top thereof for covering the foot side of the mattress, a left side depending from the top thereof for covering the left side of the mattress, and a right side depending from the top thereof for covering the right side of the mattress, a flat sheet including a top for covering at least a portion of the top of the fitted sheet, and a foot side depending from the top thereof for covering at least a portion of the foot side of the fitted sheet, a bed skirt including a foot side, a left side, and a right side; and structure fixing the foot side of the flat sheet to the foot side of the fitted sheet, fixing the foot side of the bed skirt to the foot side of the fitted sheet, fixing the left side of the bed skirt to the left side of the fitted sheet, and fixing the right side of the bed skirt to the right side of the fitted sheet.

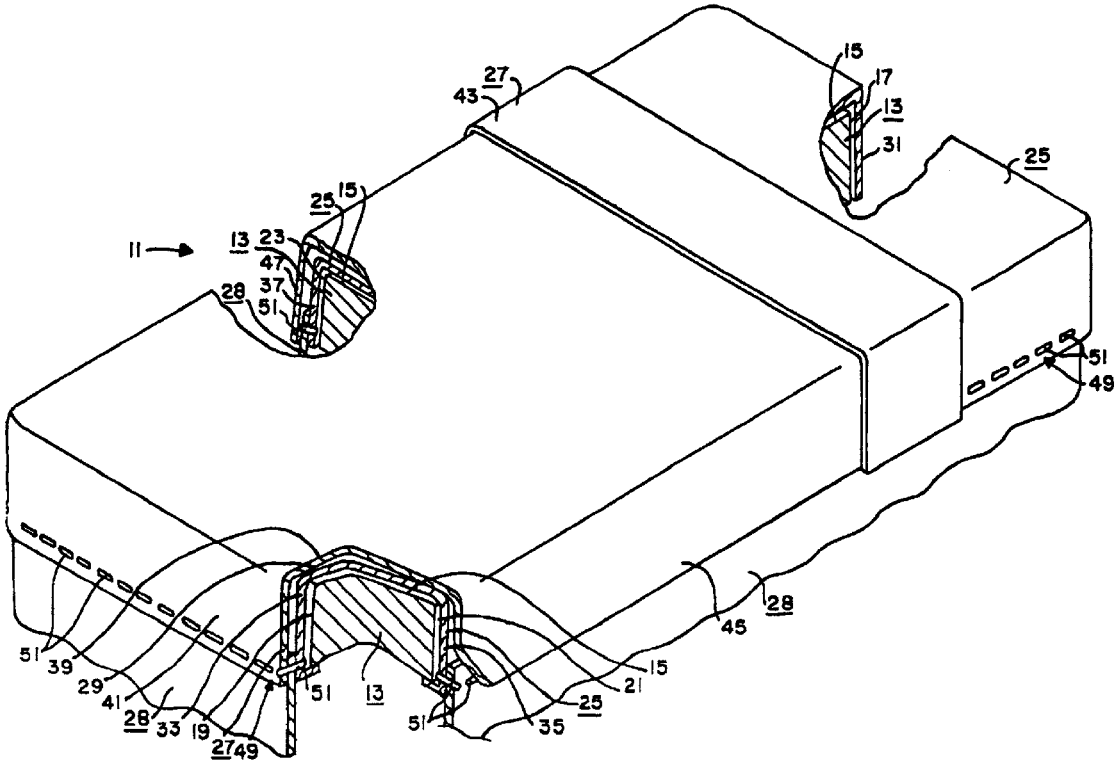

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claim 1 is cancelled.

Claim 2 was not reexamined.

* * * * *